US005117724A

United States Patent [19]

Gardner

[11] Patent Number: 5,117,724

[45] Date of Patent: Jun. 2, 1992

[54] DRUMSTICK CARRIER APPARATUS AND METHOD

[76] Inventor: Gary D. Gardner, 1777 W. Crystal Rock Ave., Salt Lake City, Utah 84116

[21] Appl. No.: 640,269

[22] Filed: Jan. 11, 1991

[51] Int. Cl.[5] ..... G10D 13/02

[52] U.S. Cl. ..... 84/421; 84/453; 206/314

[58] Field of Search ..... 84/411 R, 421, 422.4, 84/453; 206/314, 443; 224/910; 108/50

[56] References Cited

U.S. PATENT DOCUMENTS 607,130 7/1898 Rapp ..... 206/314 X 4,750,402 6/1988 Markey ..... 84/453

*Primary Examiner*—L. T. Hix

*Assistant Examiner*—Howard B. Blankenship

*Attorney, Agent, or Firm*—J. Winslow Young

[57] ABSTRACT

A foldable stick bag for drumsticks, the stick bag being configured to be removably mounted to a drummer's stool and support a plurality of drumsticks in a readily accessible configuration at the sides of the drummer's stool. The stick bag is fabricated from a fabric-like material and with a seat portion that generally corresponds to the profile of the seat of the drummer's stool. A skirt depends downwardly from the periphery of the seat portion and supports a plurality of open-top pockets into which the drumsticks are inserted. Partial platforms in the pockets allow the drummer to selectively elevate preselected drumsticks above the rest of the drumsticks in the pockets. A cover encloses the exposed portions of the drumsticks and can be folded behind the drumsticks when the stick bag is mounted on the drummer's stool. A handle is secured to the skirt along with a bundling strap. The bundling strap secures the stick bag as a bundle with the handle exposed to accommodate hand carrying of the stick bag.

20 Claims, 3 Drawing Sheets

DRUMSTICK CARRIER APPARATUS AND METHOD

DISCLOSURE DOCUMENT

This patent application includes Disclosure Document Ser. No. 243,961 filed Jan. 25, 1990.

BACKGROUND

1. Field of the Invention

This invention relates to drumstick carriers and, more particularly, to a foldable drumstick carrier apparatus and method, the drumstick carrier being mountable on a stool while supporting a plurality of drumsticks in a plurality of accessible positions and being foldable to provide secure and convenient transportation and/or storage of the drumsticks.

2. The Prior Art

The musical entertainment industry depends heavily upon the musical contribution of a drum player or drummer to provide the desired sound effect for an orchestra or a musical band. Customarily, the drummer utilizes a plurality of percussion instruments arrayed in easily accessible locations around the drummer's position. These percussion instruments, include various types of drums, cymbals, bells, and the like, and are struck by the drummer in a predetermined rhythmic pattern to create the desired sound effect. In striking these percussion instruments, the drummer uses a variety of drumsticks, many of which are specially configured for a specific function. Accordingly, it is common practice for a drummer to have a variety of types of drumsticks readily available in an easily accessible format. Further, the accidental loss of a drumstick through slippage from the grasp of the drummer or even breakage of the drumstick requires that the drummer have immediate access to a replacement drumstick.

Historically, it has been the practice for a drummer to have a selection of drumsticks available in what is referred to in the art as a stick bag. A conventional stick bag is generally configured as a pouch segmented into a plurality of pockets into which the various types of drumsticks are segregated. The pouch is foldable for security purposes and convenience in transporting the drumsticks. The pouch is usually suspended from the side of an adjacent drum so as to be more or less readily available to the drummer during a performance.

However, unless two stick bags are used, the stick bag is mounted to either the right or the left side of the drummer. This means that if it is necessary to replace the drumstick in, say, the left hand but the stick bag is mounted to the right side of the drummer, the drummer must shift drumsticks between hands in order to retrieve the desired drumstick with the right hand and then transfer that drumstick to the left hand. This activity is highly undesirable during periods of play since it is a readily noticeable interruption in the music supplied by the drummer.

Further, the conventional stick bag is a simple carrier with a series of open pockets into which the drumsticks are inserted. The depth of the pockets is sufficient to retain the drumsticks against loss during handling of the stick bag which means that the drumsticks are not necessarily readily available to be quickly retrieved by the drummer.

In view of the foregoing it would be a significant advancement in the art to provide a stick bag for drumsticks whereby the drumsticks are readily available to each hand of the drummer. Another advancement in the art would be to provide a stool cover for the drummer's stool, the stool cover including pockets on each side of the stool cover with the pockets holding the drumsticks in a readily accessible manner. It would also be advantageous to provide platforms in the pockets of the stool cover so as to present preselected drumsticks in an even more readily accessible position by having them elevated incrementally above the other drumsticks in the pocket. Such a novel apparatus and method is disclosed and claimed herein.

BRIEF SUMMARY AND OBJECTS OF THE INVENTION

The present invention is directed generally to providing a drummer with a stick bag that is configured as a removable stool cover for the drummer's stool. The stool cover is fabricated from a fabric so as to be foldable into an easily transportable configuration. The stick bag includes a plurality of pockets on each side of the stool cover. Selected pockets also include partial platforms which can be used to selectively elevate preselected drumsticks at different elevations for greater accessibility. A strip of fabric around the upper periphery of the stool cover serves as a removable drumstick cover that can be folded behind the drumsticks to expose the upper ends of the drumsticks. When folded across the drumsticks the drumstick cover completely encloses the drumsticks for security during storage and transportation of the stick bag. A bundling strap and a pair of handles are included on the stick bag for convenience in folding and carrying the stick bag.

It is, therefore, a primary object of this invention to provide improvements in stick bags for drumsticks.

Another object of this invention is to provide improvements in the method for presenting replacement drumsticks to the drummer.

Another object of this invention is to provide a stick bag for drumsticks wherein the stick bag is configured as a stool cover having pockets for the drumsticks on each side of the stool.

Another object of this invention is to provide at least one platform inside a pocket of the stick bag so as to enable the drummer to selectively elevate one or more drumsticks in the pocket.

These and other objects and features of this invention will become more readily apparent from the following description in conjunction with the accompanying drawing and the appended claims.

DETAILED DESCRIPTION OF THE PREFERRED EMBODIMENT

Figure 1:
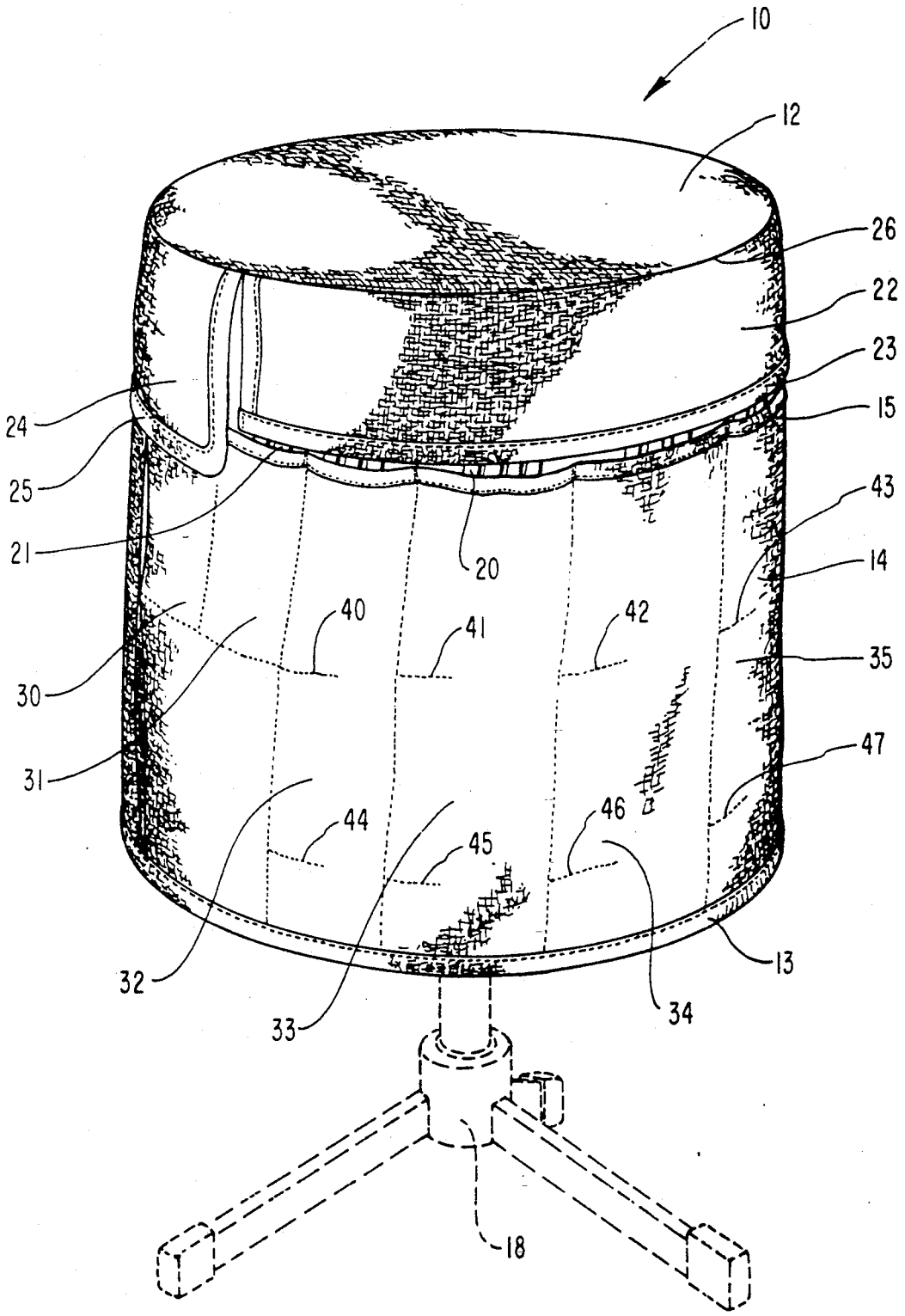
FIG. 1 is a perspective view of the novel drumstick bag of this invention shown in the environment of a stool.

The invention is best understood by the following description with reference to the drawing wherein like parts are designated by like numerals throughout and in conjunction with the accompanying claims.

GENERAL DISCUSSION

Configuring the novel stick bag apparatus of this invention as a fabric stool cover provides a number of unique advantages. A primary advantage being that replacement drumsticks are readily accessible immediately to the side of the drummer. Further, since most drummer stools swivel, the stool cover and, therefore, the pockets into which the drumsticks are placed, swivel also so that regardless of the direction to which the drummer is turned the drumsticks are readily available at the same relative position to the drummer.

The use of fabric as the material of construction for the stick bag means that it can be readily folded into a relatively compact bundle for transportation and storage. The term "fabric" includes any suitable material whether woven or nonwoven and includes materials such as felt, canvas, leather, plastic, and the like. Fabric also lends itself to being sufficiently pliant to adapt the stick bag to use as a stool cover for a range of different configurations of stools. Importantly, the novel stick bag of this invention supports a preselected number of drumsticks in a plurality of orientations for the convenience of the drummer.

DETAILED DESCRIPTION

Figure 2:
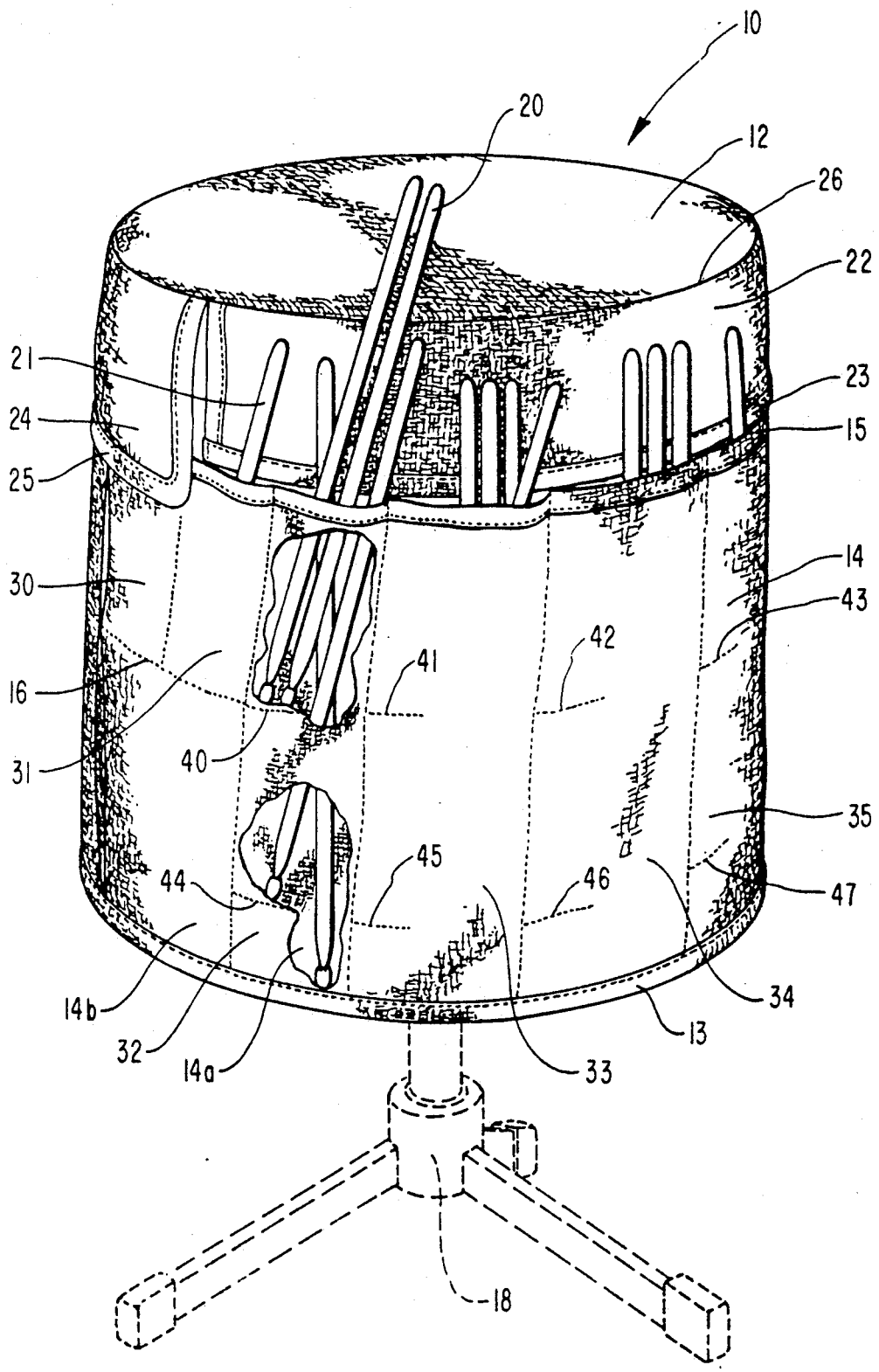
FIG. 2 is a perspective view of the drumstick bag shown with the cover tucked behind the drumsticks, portions of the stick bag shown cut away for ease in illustrating the novel platform system for the drumsticks.

Referring now to the drawing with particular emphasis on FIGS. 1 and 2, the novel stick bag of this invention is shown generally at 10 and includes a circular seat 12 with a cylindrical skirt 14 depending downwardly from seat 12. Seat 12 is shown in this presently preferred embodiment as being circular although seat 12 could be square, rectangular, triangular, oval, or any other geometric shape since the shape of seat 12 has little, if any, impact on the novel features of stick bag 10. Skirt 14 is configured with a double wall consisting of an inner wall **14*a* and an outer wall 14*b* (FIG. 2). The space between inner wall 14*a* and outer wall 14*b* is segregated vertically into a plurality of pockets 30–35 into which a plurality of drumsticks 20 and 21** are placed.

The actual number of pockets 30–35 will vary with the size of drumstick bag 10 as well as the actual size of pockets 30–35. At this point it is important to emphasize that both sides of stick bag 10 are identical so that a matching set of pockets 30–35 are found on the other side of stick bag 10.

Stick bag 10 is mounted on a stool 18, the bottom portion of which is seen below skirt 14 and is shown in broken lines. Stool 18 may be selected from any suitable stool according to the particular taste of the drummer (not shown). Advantageously, the placement of stick bag 10 on stool 18 means that drumsticks 20 will be presented at a convenient and readily accessible location for the drummer seated on stool 18. Further, since stool 18 is generally configured as a swivel stool, and the drummer is seated on seat 12, pockets 30–35 are always available to the drummer at the same relative location regardless of which direction the drummer is facing when access to drumsticks 20 is required.

Seat 12 may be a single layer of fabric or may be padded to meet the particular requirements of the drummer. In either configuration, seat 12 is designed as the holding member for securing the desired orientation of pockets 30–35 relative to the placement of stick bag 10 on stool 18.

Figure 3:
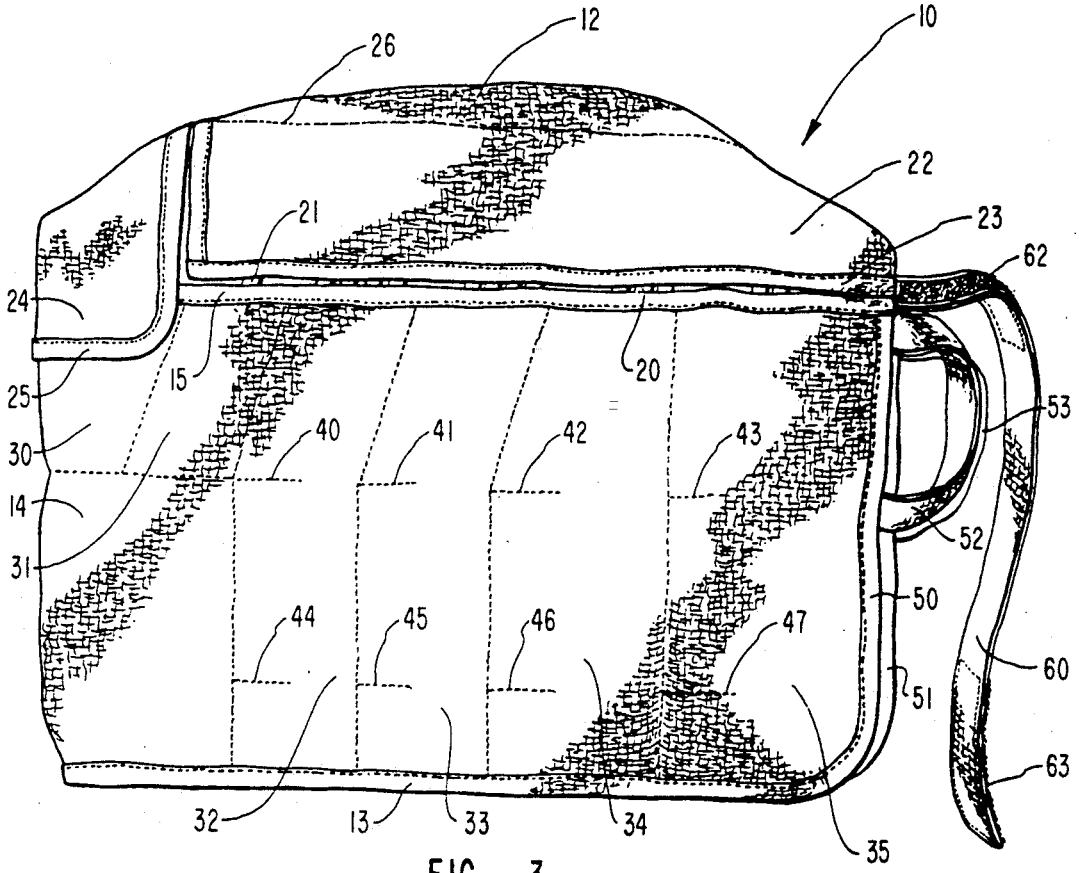
FIG. 3 is a plan view of the drumstick bag folded into a flat configuration.

A cover 22 extends downwardly from seat 12 and generally conforms to the external profile of stick bag 10. Cover 22 is also generally coextensive with outer wall 14b (FIG. 2) in that it overlays inner wall 14a thereunder, inner wall 14a forming the entire cylindrical surface of skirt 14. Cover 22 is not attached to inner wall **14*a* but is secured only along a circular seam 26 to seat 12. The purpose of cover 22 is to enclose the upper ends of drumsticks 20 when they are inserted fully into pockets 30–35. This feature is shown in FIGS. 1 and 3. During periods of use of stick bag 10, cover 22 is folded behind drumsticks 20 thereby exposing drumsticks 20 to the drummer in an immediately accessible manner, as shown in FIG. 2**.

Accessibility of drumsticks 20 is enhanced significantly by the inclusion of a plurality of partial platforms formed in each of pockets 32–35 as shown by partial platforms 40–47. Each of partial platforms 40–47 are created in the respective pockets as horizontal seams joining inner wall **14*a* to outer wall 14*b* (FIG. 2) along a portion of the width of pockets 32–35. This unique feature is best shown in FIG. 2 wherein the cutaway portions reveal underlying partial platforms 40 and 44 in pocket 32. It will be noted that of the four drumsticks 20 held in pocket 32 that the ends of two drumsticks 20 are resting on partial platform 40 while the end of one drumstick 20 is resting on partial platform 44 and the remaining one drumstick 20 is inserted fully into pocket 32 with the end of that particular drumstick 20 resting on the bottom of pocket 32**.

Accordingly, partial platforms 40–47 allow the drummer to selectively position drumsticks 20 in any preselected configuration ranging between the high elevation provided by the upper partial platforms 40–43 or at an intermediate elevation provided by partial platforms 44–47. Alternatively, drumsticks 20 can be simply left fully inserted to the full depth into each of pockets 30–35.

Pockets 30 and 31 do not have partial platforms therein since each is configured as a shallow-depth pocket by placement of a seam 16 which joins inner wall **14*a* to outer wall 14*b* across the full width of pockets 30 and 31. Pockets 30 and 31 are specifically designed as specialty pockets to carry specialty drumsticks such as specialty drumstick 21 or even specialty tools (not shown) useful for the assembly and tuning of the drums, etc. (not shown). A separate cover, cover 24, covers pocket 30 but is not designed to be folded behind as is cover 22 since the contents of pocket 30 are not generally required to be readily accessible during a performance as are the contents of pockets 31–35**.

Figure 4:
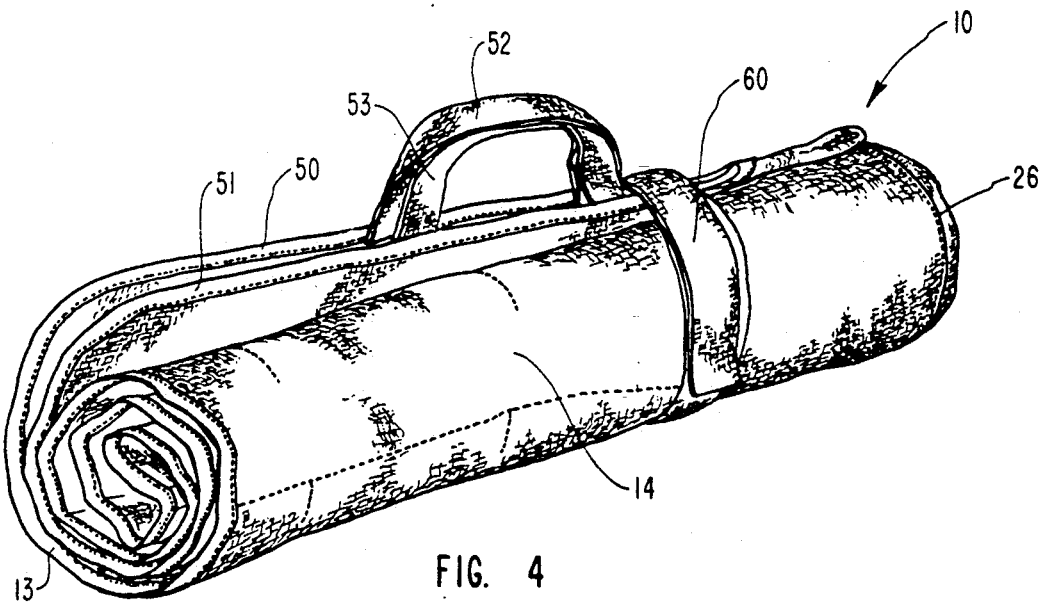
FIG. 4 a perspective view of the drumstick bag rolled and tied into a hand-portable bundle.

Referring now more particularly to FIGS. 3 and 4, the novel stick bag 10 of this invention is shown removed from stool 18 (FIGS. 1 and 2). With particular reference to FIG. 3, stick bag 10 has been removed from stool 18 (FIGS. 1 and 2) by the simple expedient of lifting upwardly on seat 12 so that seat 12 extends upwardly from the body of stick bag 10. Prior to removing stick bag 10 from stool 18 (FIGS. 1 and 2) drumsticks 20 are inserted the full depth into pockets 32–35 and cover 22 is folded over the ends of drumsticks 20 and 21 thereby securely enclosing drumsticks 20 and 21 within the confines of stick bag 10.

Skirt 14 is not configured as a complete cylindrical surface around the periphery of seat 12 but is split along a vertical seam 50 at the back of stick bag 10. A matching seam 51 at the other end of skirt 14 abuts seam 50 at the back of stick bag 10. A pair of handles 52 and 53 are formed as fabric loops sewn to each of seams 50 and 51, respectively. A strap 60 is sewn to skirt 14 at a position corresponding to the joinder of cover 22 or, more particularly, an edging tape 23 with the upper edge of outer wall **14*b* as defined by edging tape 15. Strap 60 includes a matching set of hook and loop fastener 62 and 63, respectively, such as the commercially available hook and loop fastener material sold under the Velcro trademark of Velcro USA, Inc., of Manchester, NH. Strap 60 is designed to securely hold stick bag 10 in a rolled configuration so as to render stick bag 10 into an easily transportable bundle shown at FIG. 4. This is accomplished by folding seat 12 downwardly between the two sections of skirt 14 until seam 26 defines the edge of the profile of stick bag 10. Thereafter, the end of stick bag 10 as represented by pocket 30 is rolled toward seams 50 and 51 until stick bag 10 is tightly rolled into a bundle. Strap 60 is then wrapped around the resulting bundle and secured with the hook and loop fasteners 62 and 63. In this configuration, handles 52 and 53 are supported outwardly so as to be readily accessible for carrying stick bag 10. Importantly, drumsticks 20 and 21 are securely enclosed inside stick bag 10** thereby effectively eliminating any risk of their being inadvertently dislodged and lost.

The Method

Customarily, stick bag 10 is usually folded into the bundle shown in FIG. 4 not only for transportation thereof but also for storage. When arriving at a destination where stick bag 10 is to be used during a performance, strap 60 is released and unwrapped from around bundled stick bag 10. Stick bag 10 is then unrolled and placed over stool 18 with seat 12 corresponding to the seat (not shown) of stool 18. Skirt 14 depends downwardly in a cylindrical profile on stool 18. Cover 22 is folded behind drumsticks 20 and 21 while selected drumsticks 20 are elevated using any one of partial platforms 40–47. Thus arrayed, drumsticks 20 are presented in a readily accessible manner for the drummer (not shown) seated on stool 18. During the performance various drumsticks 20 and 21 will be used or replaced from stick bag 10.

After the performance, drumsticks 20 are again inserted to the full depth of pockets 32–35 and cover 22 is folded across the exposed ends of drumsticks 20 and 21. Seat 12 is lifted to remove stick bag 10 from stool 18 and then folded inwardly to reduce the external profile of stick bag 10 to that defined by seam 26 and lower edge 13. Thereafter, stick bag 10 is rolled up until strap 60 can again be used to securely tie stick bag 10 into a compact bundle with handles 52 and 53 presented at a readily accessible position.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A foldable stick bag for a plurality of drumsticks comprising:

a seat element adapted to be placed on a seat of a drummer's stool;

a skirt element depending downwardly from said seat element; and a plurality of pockets in said skirt element, said pockets being adapted to telescopically receive therein said plurality of drumsticks.

2. The foldable stick bag defined in claim 1 wherein said stick bag is fabricated from a fabric material so as to be foldable thereby enclosing said drumsticks in said pockets.

3. The foldable stick bag defined in claim 1 wherein said skirt element includes a cover depending downwardly from an upper periphery of said skirt element, said cover providing a securement means for said drumsticks in said pockets.

4. The foldable stick bag defined in claim 1 wherein said pockets are oriented generally vertically and include at least one partial platform in at least one of said pockets said partial platform being oriented at a preselected elevation in said pocket to releasably receive a drumstick in an elevated orientation in said pocket.

5. The foldable stick bag defined in claim 1 wherein said skirt element includes a vertical slit to accommodate said stick bag being removably mounted on a drummer's stool.

6. The foldable stick bag defined in claim 5 wherein said skirt element includes at least one handle mounted to said skirt element adjacent said vertical slit.

7. The foldable stick bag defined in claim 6 wherein said skirt element includes a binding strap, said binding strap tying said stick bag into a bundle, with said drumsticks folded in said bundle and with said handle exposed to accommodate hand carrying of said bundle.

8. The foldable stick bag defined in claim 1 wherein said skirt element includes at least one utility pocket and a cover for said utility pocket.

9. The foldable stick bag defined in claim 1 wherein said skirt element includes a bottom edge and said pockets have a bottom corresponding to said bottom edge and sides that are generally vertical with an open top spaced from said seat element an incremental distance, the upper portion of at least one of said pockets having a rearwardly slanted section.

10. A foldable stick bag for a plurality of drumsticks comprising:

a seat element adapted to be releasably mounted on a seat of a drummer's stool;

a skirt element depending downwardly from said seat element when said seat element is mounted on said seat of said drummer's stool, said skirt element having a bottom edge and a front and a back, said front generally corresponding to a front of said drummer's stool;

a plurality of drumstick pockets in said skirt element, said drumstick pockets having an open top and a bottom generally corresponding to said bottom edge of said skirt element, said open top being spaced incrementally below said seat element; and a cover extending downwardly from said seat element into juxtaposition with said open top, said cover retaining said drumsticks in said drumstick pockets during periods of transportation and storage of said foldable stick bag, said cover being foldable behind said drumsticks after placement of said foldable stick bag on said drummer's stool.

11. The foldable stick bag defined in claim 10 wherein said skirt element is incrementally longer than said drumsticks with said pockets having a depth less than the length of said drumsticks so as to support said drumsticks with a portion of said drumsticks extending above said open top of said drumstick pockets to accommodate hand grasping of said drumsticks.

12. The foldable stick bag defined in claim 11 wherein at least one of said drumstick pockets includes at least one partial platform formed above said bottom of said pockets, said partial platform selectively elevating at least one drumstick in said drumstick pocket.

13. The foldable stick bag defined in claim 10 wherein said skirt element includes a vertical slit at said back, said vertical slit facilitating removably mounting said foldable stick bag on said drummer's stool.

14. The foldable stick bag defined in claim 13 wherein said skirt element includes a handle means attached to said skirt element adjacent said vertical slit, said handle means providing a handle for carrying said foldable stick bag in a folded configuration.

15. The foldable stick bag defined in claim 13 wherein said skirt element includes a strap means affixed to said skirt element adjacent said vertical slit, said strap means releasably securing said foldable stick bag as a bundle for transportation and storage of said foldable stick bag.

16. A method for carrying a plurality of drumsticks comprising:

forming a foldable stick bag for said drumsticks, said foldable stick bag including a seat element adapted to be removably placed on a seat of a drummer's stool and a skirt element depending downwardly from said seat element;

fabricating a plurality of drumstick pockets in said skirt element, said drumstick pockets having a depth incrementally less than the length of said drumsticks so as to support said drumsticks in said drumstick pockets with an exposed portion of said drumsticks extending above said drumstick pockets;

securing a cover to said foldable stick bag, said cover selectively enclosing said exposed portion of said drumsticks extending above said drumstick pockets;

placing a plurality of said drumsticks in said drumstick pockets and covering said exposed portion with said cover;

folding said foldable stick bag and carrying said foldable stick bag to said drummer's stool;

unfolding said foldable stick bag and mounting said foldable stick bag to said drummer's stool with said seat element placed on said seat of said drummer's stool and with said skirt element depending downwardly from said seat of said drummer's stool; and removing said cover from said exposed portion to present said drumsticks in a readily accessible orientation at the sides of said drummer's stool.

17. The method defined in claim 16 wherein said fabricating step includes forming at least one partial platform in at least one drumstick pocket and selectively placing at least one drumstick on said partial platform after said removing step thereby elevating said drumstick.

18. The method defined in claim 16 wherein said fabricating step includes forming a vertical slit in said skirt element, said vertical slit facilitating removably mounting said foldable drumstick bag on said drummer's stool.

19. The method defined in claim 18 wherein said forming step includes attaching a handle to said skirt element adjacent said vertical slit, said handle extending from said foldable stick bag in said folded configuration to accommodate hand carrying said foldable stick bag.

20. The method defined in claim 18 wherein said forming step includes affixing a bundling strap to said skirt element adjacent said vertical slit, said bundling strap tying said foldable stick bag in said folded configuration.

* * * * *